US005809571A

United States Patent [19]

Spitzer

[11] Patent Number: 5,809,571

[45] Date of Patent: Sep. 22, 1998

[54] SPORTS GLOVE, IN PARTICULAR A GOALIE GLOVE

[75] Inventor: Thomas Spitzer, Balingen, Germany

[73] Assignee: Uhlsport GmbH, Balingen, Germany

[21] Appl. No.: 821,923

[22] Filed: Mar. 21, 1997

[30] Foreign Application Priority Data

Mar. 22, 1996 [DE] Germany ..... 196 11 335.0

[51] Int. Cl.[6] ..... A41D 19/00

[52] U.S. Cl. ..... 2/161.1; 2/163

[58] Field of Search ..... 2/16, 18, 20, 21, 2/159, 160, 161.1, 163

[56] References Cited

U.S. PATENT DOCUMENTS

| | | | |
|---|---|---|---|
| 4,768,234 | 9/1988 | Yamamoto | 2/16 |
| 4,930,162 | 6/1990 | Cote | 2/163 |
| 4,995,119 | 2/1991 | Codkind | 2/163 |
| 5,138,718 | 8/1992 | Willard | 2/159 |
| 5,168,578 | 12/1992 | Stanley | 2/19 |
| 5,592,688 | 1/1997 | LaRonge et al. | 2/19 |
| 5,604,934 | 2/1997 | Willett | 2/161.1 |
| 5,720,047 | 2/1998 | Spitzer | 2/161.1 |

FOREIGN PATENT DOCUMENTS

| | | |
|---|---|---|
| 2721538 C2 | 5/1977 | Germany . |
| 3516545 C2 | 5/1985 | Germany . |
| 3738005 A1 | 11/1987 | Germany . |
| 3823168 C2 | 7/1988 | Germany . |
| 9115257 U | 12/1991 | Germany . |

*Primary Examiner*—Michael A. Neas

*Attorney, Agent, or Firm*—Shlesinger Arkwright & Garvey LLP

[57] ABSTRACT

The present invention is directed to a sports glove, in particular a goalie glove comprising an inward glove part made of an impact-damping material preferably based on foamed latex, and further comprising a glove upward part covering the back of the human hand and side parts connecting the glove upward and inward parts and glove intra-finger pieces, the inward glove part evincing a larger area relative to the anatomic requirements of the inside surface of the human hand. A pocket filled with a padding material and corresponding in geometry and manufacture to a human finger is mounted at the outside adjacent to the human small finger between the human small finger and a side part, and/or at the outside of the human index finger facing the thumb and/or at the thumb outside away from the human index finger. The present invention provides a noticeable and functional enlargement of the catching area subtended by the inward glove part and at the same time impact-damping protection is provided for especially exposed and injury-prone zones of the human hand.

14 Claims, 7 Drawing Sheets

SPORTS GLOVE, IN PARTICULAR A GOALIE GLOVE

FIELD OF THE INVENTION

The invention concerns a sports glove and in particular a glove for a soccer goalie.

BACKGROUND OF THE INVENTION

In the development of sports gloves and in particular those used by soccer goalies, it is known to make the inward portion of such gloves as large as possible (i.e., to achieve a large "catching area") and thereby optimize the catching function of the glove.

Thus, it is a conventional practice to fit the goalie glove with external seams at least in the inward zone, and contrary to the manufacture of other types of gloves. The external seams entail a substantially planar inward covering of which the outer limit clearly projects beyond the periphery of the glove fingers and the whole hand.

In addition to the above practice for enlarging the "catching area" of a goalie glove, other special steps are known to reach that objective.

For example, German patent GM G 87 14 903.6 discloses a goalie glove of which the inward hand portion between the fingers (thumb excepted) forms at least a partly closed outer surface. The resultant enlargement of the "catching area" is relatively minor. Moreover, it involves a tradeoff whereby the pertinent four glove fingers are hardly able to move relative to each other.

German patent document 38 23 168 C2 furthermore proposes to enlarge the "catching area" of a goalie glove whereby the inward portion, which as a rule consists of foamed latex, shall also include the side parts and the pieces between the glove fingers. This objective is achieved in simple manner by omitting the seams present in conventional goalie gloves between the inward portion and its adjoining side parts and the pieces between the glove fingers. In this approach, the possible increase in the "catching area" is also relatively minor. Moreover and in a disadvantageous manner, the side parts and pieces between the glove fingers, which are integral with and functionally part of said inward portion, are not coplanar with the inward portion, and thus, oppose the desired optimization of the catch function.

OBJECTS AND SUMMARY OF THE INVENTION

In the light of the above state of the art, it is the object of the present invention to achieve a noticeable and functionally effective (rather than an insignificant) increase of the "catching area" formed by the inward part of the glove and to simultaneously create impact-damping protection for the especially exposed hand zones that may be in danger of injury.

This problem is solved by providing a sports glove and especially a goalie glove comprising an impact-damping inward glove part made of a material based preferably on foamed latex and of glove upward part covering the back of the human hand and of side parts connecting the upward and inward glove parts and of intra glove-finger pieces, wherein the inward glove evinces a larger area relative to the anatomic requirements of the inside human hand and wherein each approximately corresponds in geometry and design to a glove finger formed between the human little finger and the side part and/or at the outside of the human index finger facing the glove thumb and/or at the outside of the glove thumb away from the human index finger, said pocket being filled with a padding material.

The present invention is also directed to a sports glove and in particular a goalie glove comprising an inward glove part made of an impact damping material, preferably based on a foamed latex, and of a glove upward part covering the back of the human hand and further of side parts connecting the glove inward and upward parts and glove intra-finger pieces, the inward glove part evincing a larger area relative to the anatomic requirements of a human hand inside surface wherein a series of pockets are provided, each approximately corresponding in geometry and design to a glove finger part and being present at the outside adjacent to the small human finger and between the small human finger and the side part and at the outside of the human index finger facing the glove thumb (27) or at the outside adjacent to the human small finger between the human small finger and the side part and at the glove thumb outside disposed away from the human index finger where said pocket is filled with a padding material.

In contrast to the state of the art discussed above, a noticeable and hence functional and considerable enlargement of the so-called "catching area" of a goalie glove is achieved by the present invention by providing a single pocket filled with padding, for instance, at the glove's outer edge and near the glove small-finger side whereby the padded pocket will project beyond the inherent surface of the inward glove part by about one finger-width in each case. In the present invention, no strict limitations exist when selecting the width of the particular padded pocket. It is within the scope of the present invention to make the pocket, as desired or needed, narrower, wider or preferably as wide as the glove fingers. The advantageous effect of noticeably increasing the "catching area" may be further compounded by using the multiple array of the invention of such padding-filled pockets in the various combinations and as described below.

The present invention offers the further advantage in that the claimed design provides, as a supplemental effect, injury protection to the human hand, and in particular the padding at the hand's outer edge on the side of the small finger. This injury protection feature provides special protection following, for example, a goalie's sideways dive when initially braking the jump during play. The protective function is optimized by providing a sports glove characterized in that pockets are respectively mounted at the outside of the users little finger and/or at the outside of the glove thumb and are filled with padding material extending over the region of the hand as far as the wrist.

These and other advantages of the claimed invention will become apparent from the following drawings taken together with the detailed description of the preferred embodiment.

DETAILED DESCRIPTION OF THE INVENTION

Figure 1:
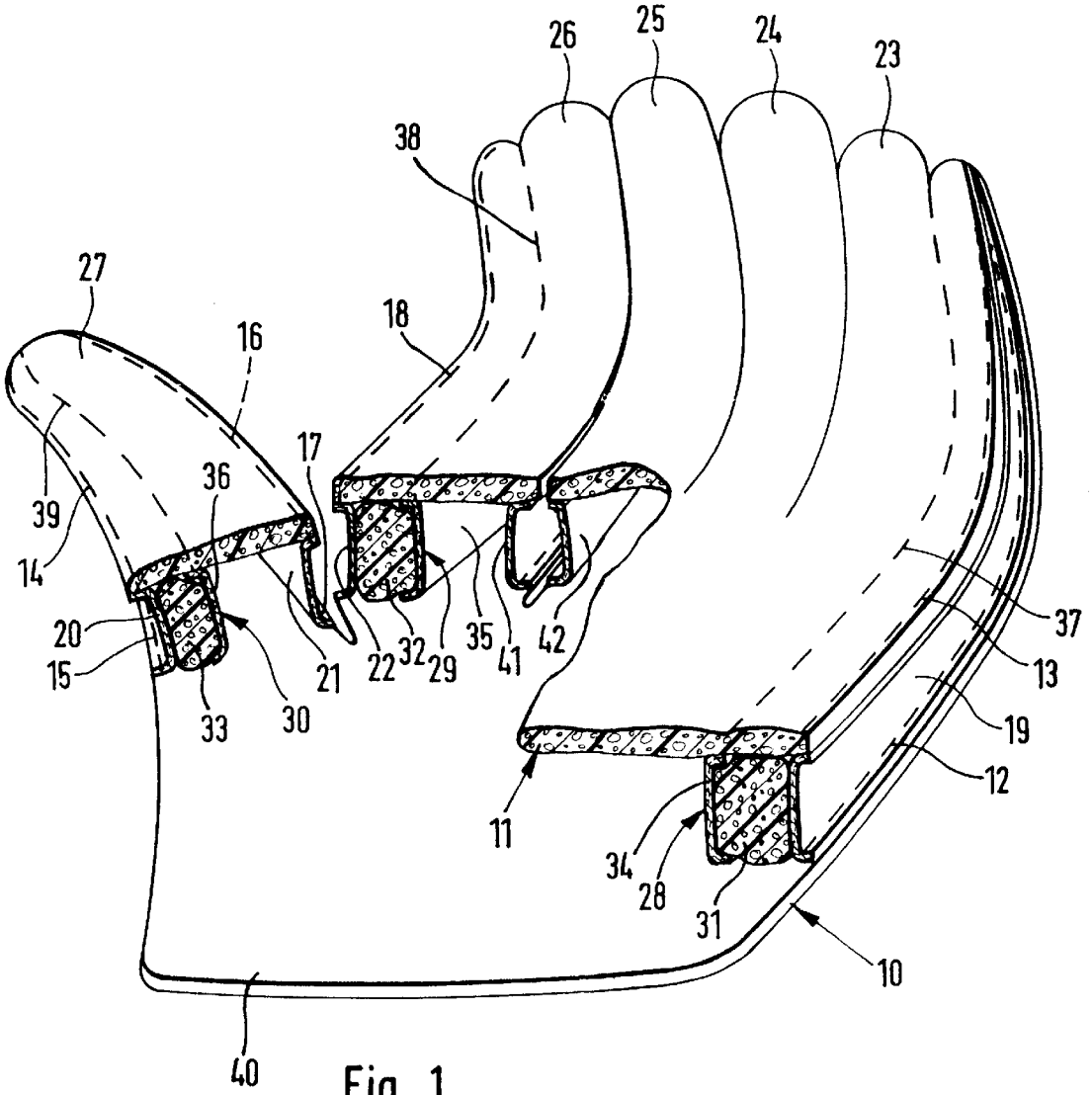
FIG. 1 is a perspective view showing the goalie glove in partly cutaway or cross-sectional view to illustrate the inwardly extending parts of the glove and the three padded pockets.

In FIG. 1, 10 denotes the whole glove upward part and 11 denotes the whole inward glove part forming the so-called catch area of the goalie glove. The upward and inward glove parts 10 and 11 are respectively comprised of conventional and practical materials used for goalie gloves. For example, latex material built up on a thin textile support forming the inward glove part 11. The upward and inward glove parts 10 and 11 may be stitched together at 12 through 18 in the known manner for goalie gloves, such junction being indirectly implemented by means of side parts 19 and 20 and glove intra-finger pieces 21, 22, 41, 42 also representing the state of the art.

To receive the five fingers of a users hand, the glove shown in FIG. 1 comprises four glove fingers 23 through 26 and a glove thumb 27, none of which are tightly joined to another and as a result, corresponding displaceability of all the five glove fingers is assured.

The goalie glove of FIG. 1 offers the substantial feature in that pockets 28, 29, 30 are apposed to the outside of the small glove finger (finger 23), of the glove index finger (finger 26) and of the glove thumb (thumb 27). The pockets evince an approximately rectangular cross-sectional shape and each are entirely filled with a soft-foam pad 31, 32, 33 respectively of a corresponding cross-sectional shape. In the same manner as the glove fingers 23 through 27 proper (see glove thumb 27 for instance), the padded pockets 28, 29, 30 each consist of two side parts 19, 34 and 22, 35 and 20,36 respectively and of an inward and upward glove part, where the latter parts, as shown in FIG. 1, are each integrally formed with the inward glove part 11 and the glove upward part 10 of the overall glove.

The dashed lines 37, 38, 39 merely indicate the seams of the inner side walls 34, 35, 36 of pockets 28, 29, 30 with the inward glove part 11. Corresponding seams (now shown) also are present for the glove upward part 10.

Advantageously, the outer side walls of the pockets 28, 29, 30 also form the already mentioned side walls 19, 20 and 22 of the whole glove.

In another feature of the invention, the padded pockets 28 and 30 not only cover the length of the particular glove finger 23 or 27 but also extend as far as the wrist of the user roughly at zone 40) in order to provide optimal impact protection, for instance, when the player strikes the ground.

The pockets 28 and/or 20 and/or 30 at the sides of the glove fingers 23, 26, 27 together with the particular paddings 31, 32, 33 also may be made to cover the finger tips of the users fingers and as a result, there is a corresponding extension of the particular glove fingers 23 and/or 26 and/or 27 (not shown in FIG. 1).

Figure 2:
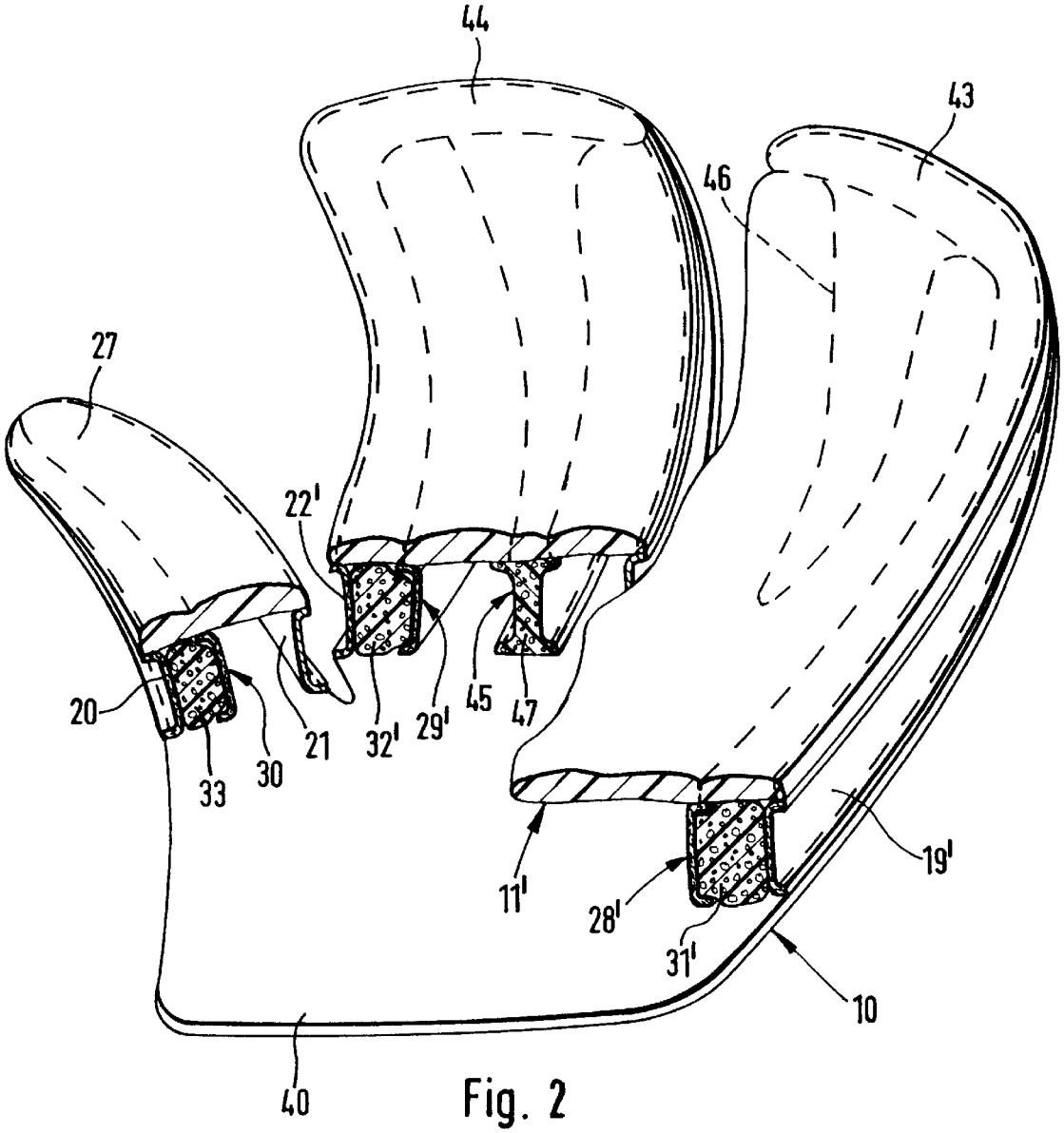
FIG. 2 is an alternative embodiment according to the present invention showing the glove in a partly cutawaway, perspective view and including the three padded pockets.

The embodiment of FIG. 2 discloses an essential feature, namely that pockets therein and denoted by 28' and 29' together with their pads 31', 32' are all arcuately extended from the outer edge 19' over the ends of the users small and ring fingers and furthermore from the inside edge 22' over the ends of the users index and middle fingers (see reference numerals 43, 44).

In order that the above design will not preclude or lessen the ability of the user to spread apart the fingers of the glove, the pairs of glove fingers are connected, not directly, but instead in each case by insertion of a V-shaped connecting pocket 45 and 46 respectively similar to webs. FIG. 2 shows the pertinent zones of the inward glove part 11' when in a web-expanded state caused by spreading of the users fingers.

For dimensional stability, the V-shaped connecting pockets 45, 46 may be filled with a soft, highly compressible foam which may be substantially compressed when the user/player forms a fist with his or her hand.

To make possible that the padded pockets 28', 29' adjoining the outside glove edges 19', 22' may be pulled over the tips of the user/players small and ring fingers and further over the tips of the user/players index and middle fingers, the pockets 28', 29' must form spans connecting the particular associated glove fingers to the particular outer edge 19' and 22' respectively. With such a design connecting each time the two glove fingers, it becomes possible—as also shown in FIG. 2—to form one common glove finger for each pair of the user/players fingers. In this manner, a "three-finger" glove is obtained and in a corresponding manner it is also possible to design a mitten offering a common glove finger for four of the user/players fingers.

It is also possible to design the glove of FIG. 2 as an embodiment variation whereby again the user/players index and middle fingers and furthermore the user/players small and ring fingers are respectively received in a common glove finger segment but the particular pair of fingers being separated, not by a V-shaped pocket such as 45, but by an integrated partition. In the present case, the partition is in the form of molded soft foam (reference numeral 47) spreading in a V-shaped manner toward the user/players finger tips. The sides of this molded component are curved to match the user/players finger contour. The purpose of this design is to ensure that the user/players fingers shall be guided more firmly than or as firmly inside this glove as in a glove where the glove fingers are individual. This design is highly significant for achieving as great as possible the catching reliability of the glove. The molded V-shaped soft foam 47 permits compression and enables the user/player to easily make a fist inside the glove, as well to allow spreading of the user/players fingers inside the glove.

As previously mentioned, the embodiment shown in FIG. 2 can be used for a glove of which the outer cut fully corresponds to a mitten but which contains inner partitions such as 47 to guide the individual fingers.

The embodiment of FIG. 2 may be advantageously varied in such manner that a conventional glove-finger cut with attached pocket spanning the user/players finger tip is used for the user/players index finger whereas the user/players middle, ring and small fingers are housed in a common glove-finger cut. Because the user/players index finger is the most important of all fingers for the catching and gripping motions, such a variation wherein the index finger enjoys unrestricted mobility is likely to be especially significant.

Figure 3:
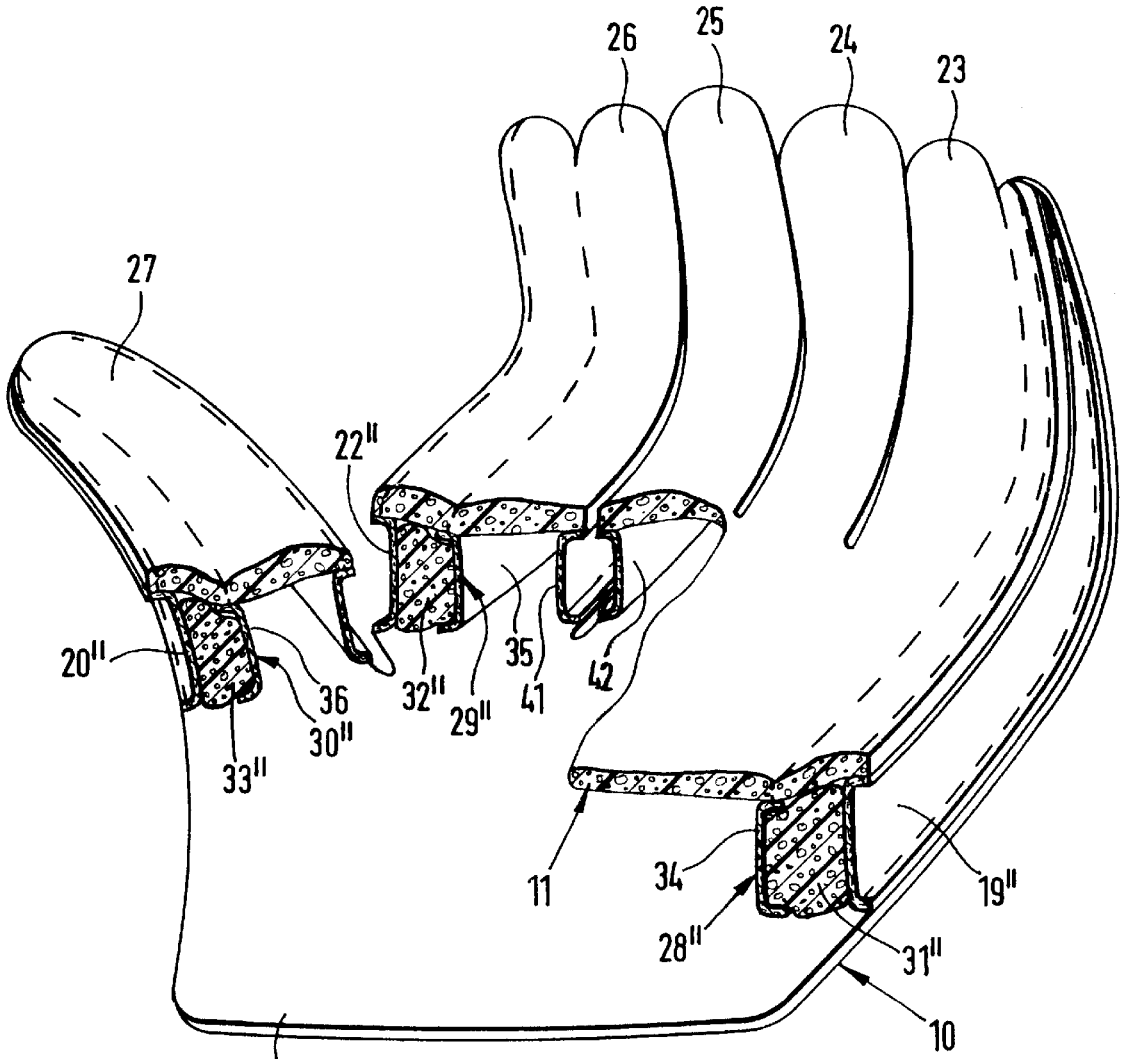
FIG. 3 is another alternative embodiment according to the present invention showing the glove in a partly cutawaway, perspective view and showing a special structure for the three padded pockets.

In most aspects, the embodiment of FIG. 3 resembles those of FIG. 1. However, the embodiment of FIG. 3 evinces the feature that the outer side parts denoted in this figure by 19", 20" and 22" are higher than the pertinent inner side walls 34, 35 and 36 of the padded pockets 28", 29" and 30", whereby the pockets are cross-sectionally trapezoidal. The pads 31", 32" and 33" evince corresponding trapezoidal cross-sections. Because of the height differentials of the side walls bilaterally bounding the pockets 28", 29" 30", there results a corresponding elevation of the inward glove part 11 which thereby is provided with a dish shaped topology favoring catching.

The above discussed feature of the embodiment of FIG. 3 is easily combined with a glove design shown in FIG. 2 as discussed above.

Figure 4:
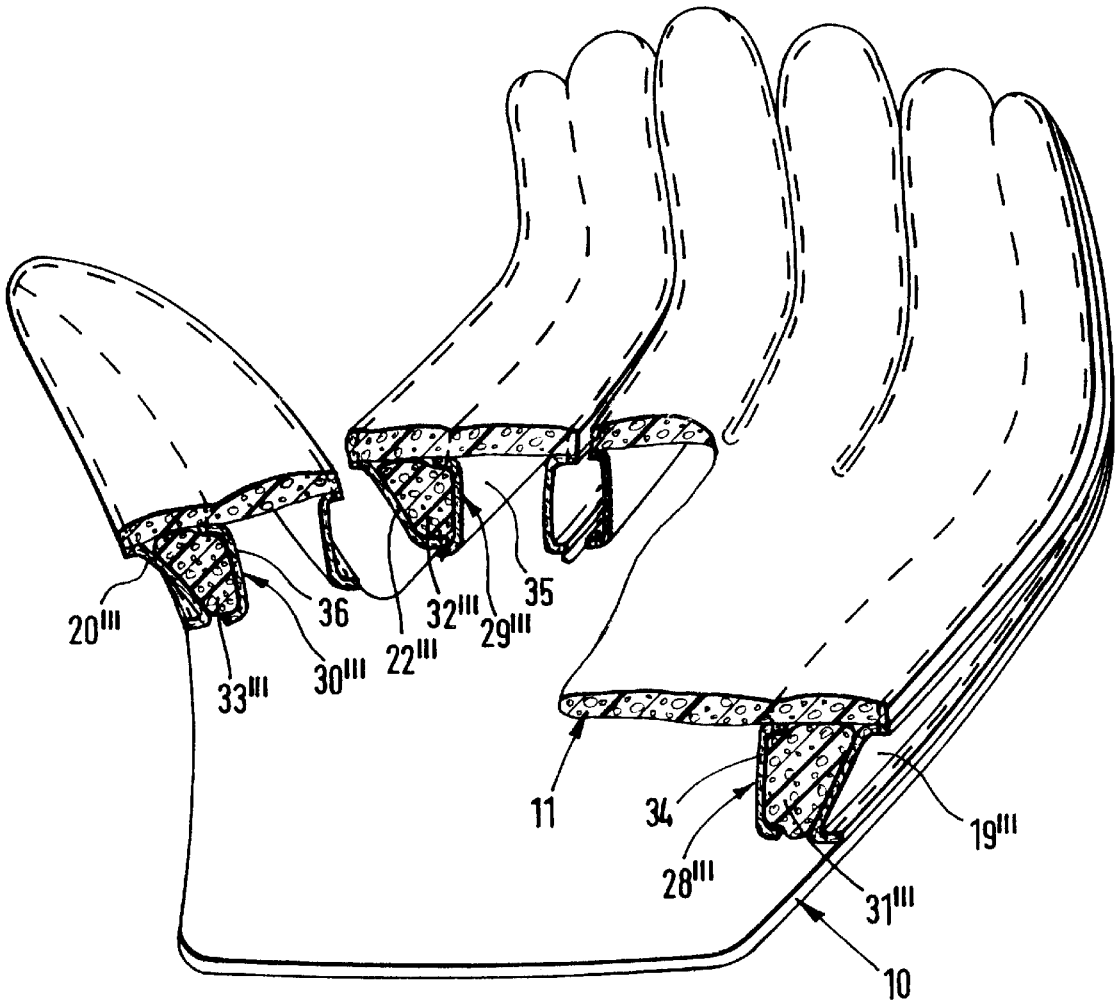
FIG. 4 is an alternative embodiment of the glove shown in FIGS. 1 and 3 and having a total of three padded pockets.

The variation of a goalie glove shown in FIG. 4 takes into account the desirability of always achieving the largest possible inward glove part 11 to enhance the glove's so-called catching area, whereas the glove upward part 10 does not require such enlargement. This feature is implemented in the variation of FIG. 4 by the corresponding slanting and widening of the side parts 19'", 22'" and 20'" respectively externally bounding the padded pockets 28'", 29'" and 30'". As a result, the pockets 28'", 29'" and 30'" and the paddings 31'", 32'" and 33'" filling them evince trapezoidal cross-sections.

In this design, the glove upward part 10 is restricted to a size needed by the hand's anatomic requirements, that is, it lacks enlargement.

As regards the other features, the embodiment of FIG. 4 corresponds to the design as set forth in FIG. 1 of a goalie glove discussed in detail above and accordingly, such details are not further repeated with respect to FIG. 4.

Figure 5:
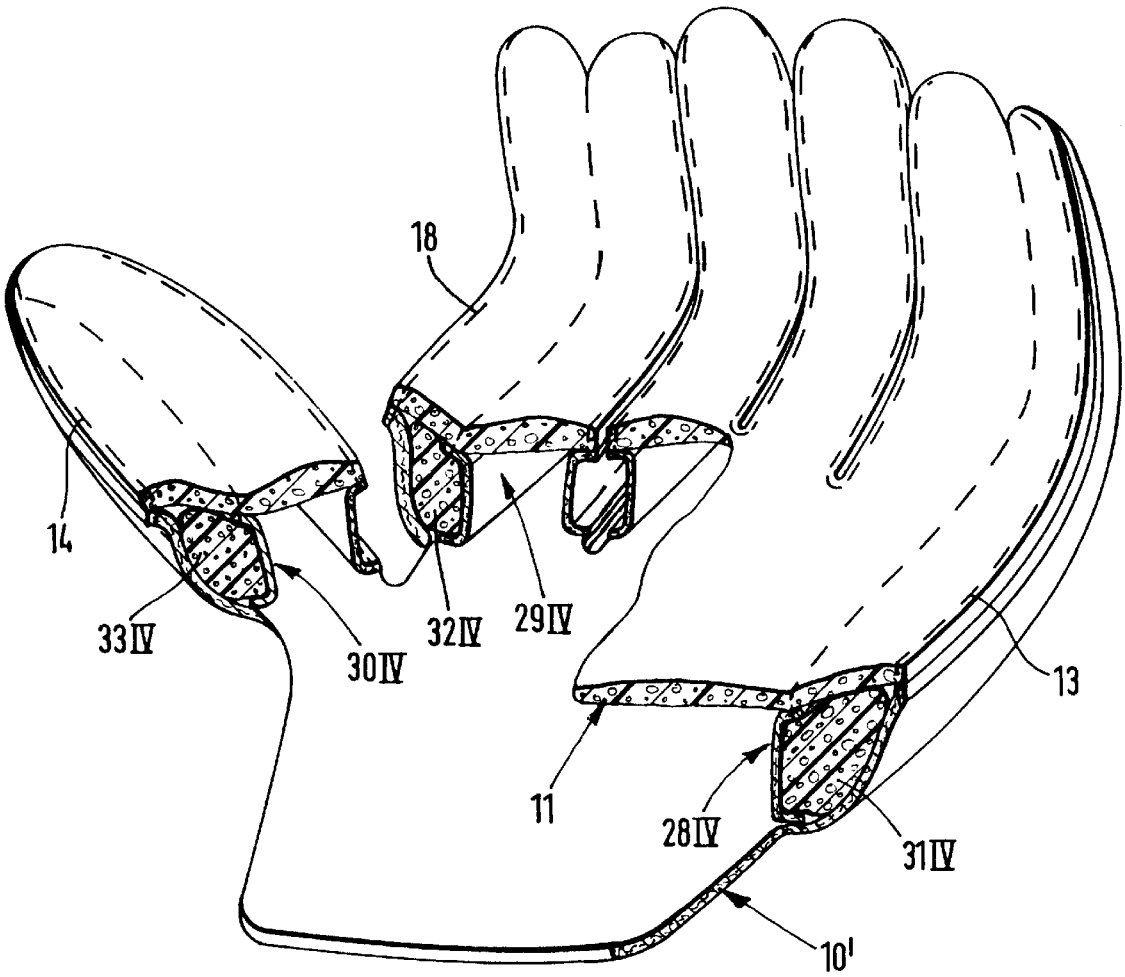
FIG. 5 is a further embodiment of a goalie glove according to the present invention including three padded pockets of which the outer walls each are integral with the upward glove part.

FIG. 4 shows another variation that is similar to the embodiment of FIG. 5. In this case and differing from the design of FIG. 4, the design feature is the elimination of separate side parts (as denoted for instance in FIG. 4 by 19'", 20'" and 22'"). Instead, these peripheral glove parts are made integral with the glove upward part 10' of FIG. 5 and with the glove upward part 10' for that purpose extending as far as the outer edges of the inward glove part 11 and being stitched to the latter part at 13, 18 and 14.

This design is also similar to the variation of FIG. 4 regarding padded pockets 28IV, 29IV and 30IV of approximately triangular to trapezoidal cross-sections. By means of suitably molded pads 31IV, 32IV and 33IV, the inside glove surface, i.e. the inward glove part 11, in this instance also is endowed with the desired planar widening shown in FIG. 5, and furthermore with a dish-like curvature of the inside glove edges (at 13, 18, 14).

Figure 6:
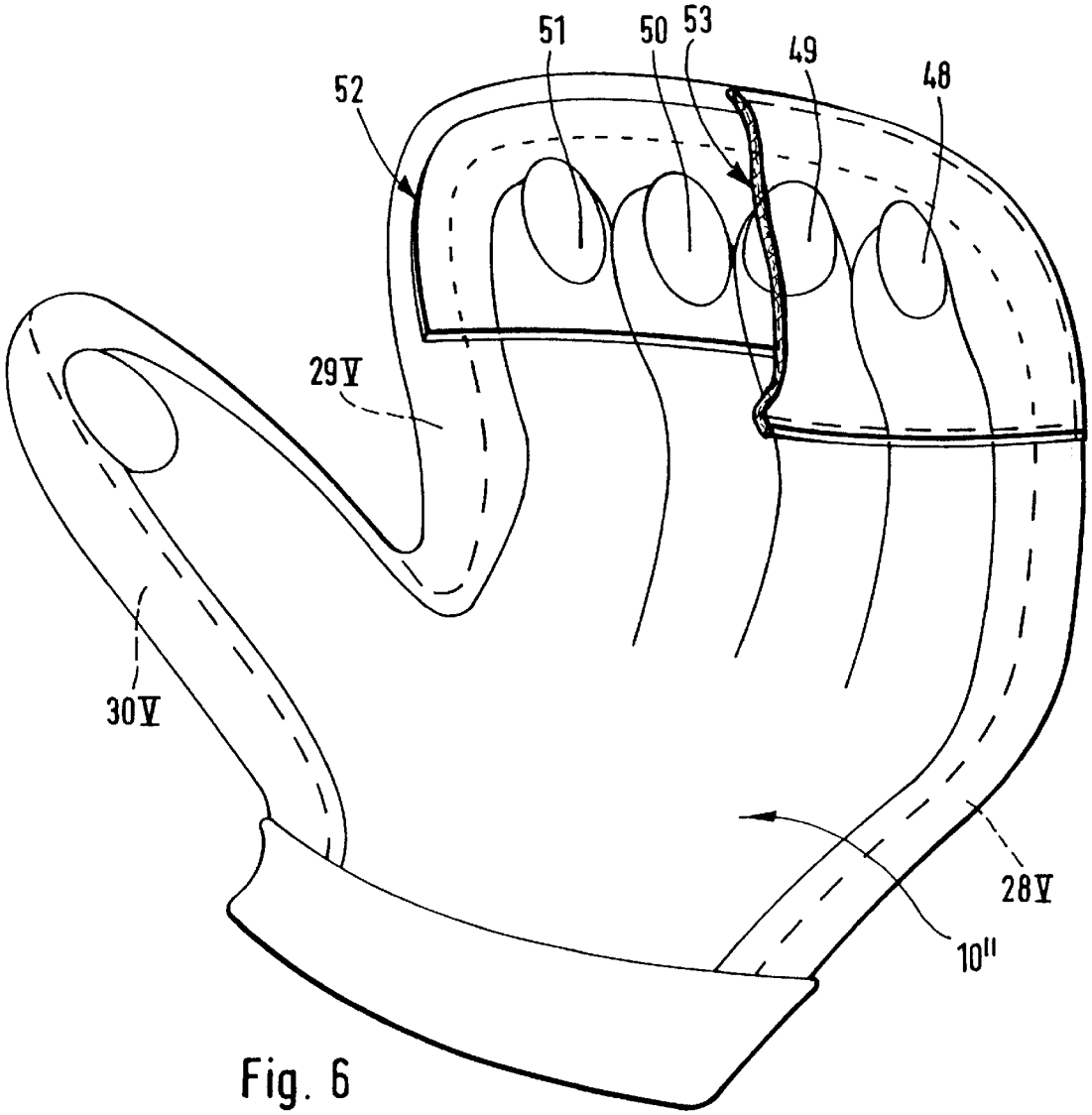
FIG. 6 is a further embodiment of the present invention showing a plan view of a goalie glove with padded pockets, partially broken away and showing a users hand therein.

FIG. 6 is a transparent and top plan view of the glove upward part 10" for glove in the form of a mitten and showing the user/players hand within the glove. In this glove, laterally apposed pockets 28V, 29V and 30V cover the tips of all five fingers of the player/user.

In order to prevent the bending back of the above fingers or hand-extension implemented by the pockets 28V, 29V and 30V filled with soft foam when an impacting ball to be caught just touches the glove finger tips, the glove upward part 10" is made stiffer in the vicinity of the human finger ends 48 through 51 by a sewn-in reinforcing component 52 preferably made of thermoplastic. As shown in FIG. 6, the reinforcing component 52 is mounted, i.e. sewn into a pocket formed by the glove upward part 10" proper and an additional cover 53. This cover 53 is shown partially cutaway in FIG. 6 to better illustrate the reinforcing component 52 below it. The cover 53 may be made of a suitable textile, leather, rubber material or of flexible plastic.

Alternatively for the embodiment of FIG. 6, the reinforcing component 52 may also be sewn-in or bonded between two layers of the glove upward part 10".

The glove "finger extension" shown in FIG. 6 and described above may be present in appropriate modified form also at the "three-finger glove" shown in FIG. 2, in which case a separate reinforcing component 52 is required for each pair of fingers. Also, such a reinforcement may be implemented with obvious adaptations to single glove fingers.

The particular reinforcing component such as 52 in FIG. 6 shall always span not only the external phalanxes but also at least enter the zone of the middle phalanxes as indicated in FIG. 6 in order that, together with the glove finger ends, it shall be able to provide adequate stiffness in this outer glove zone.

Figure 7:
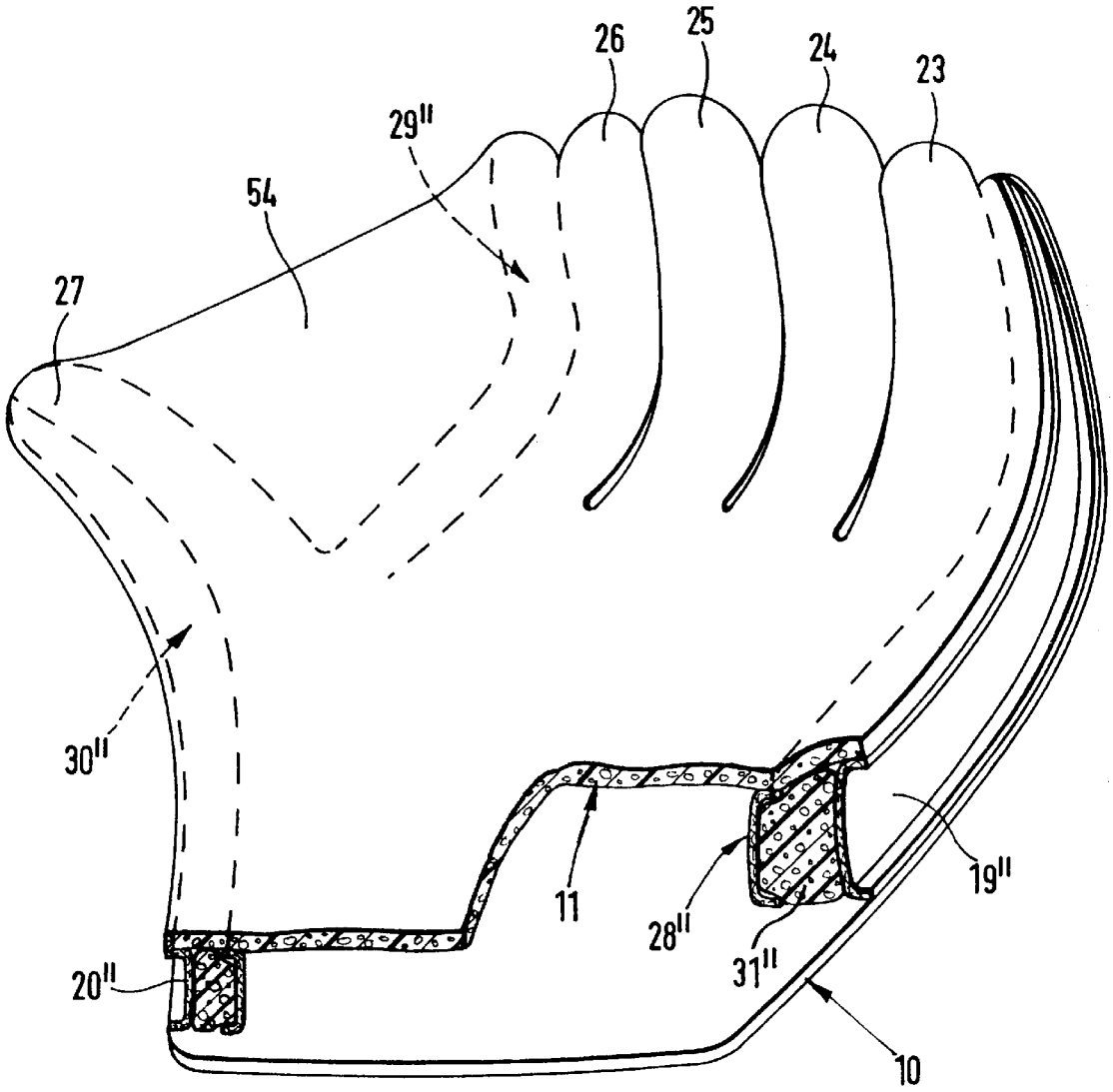
FIG. 7 is an alternative embodiment of the goalie glove shown in FIG. 3 and illustrated as a corresponding perspective view.

The goalie glove shown in FIG. 7 is a variation of the embodiment of FIG. 3 and accordingly, the same components for both embodiments are denoted by the same reference numerals. Nevertheless, the design features characterizing the glove of FIG. 7 may be implemented just as well in the other embodiments described above and shown in FIGS. 1, 2 and 4 through 6 and in those variations not individually shown in the drawings but covered by the claims. In addition, the feature of the embodiment of FIG. 7 and elucidated below can be advantageously applied to practically any goalie glove of the prior state of the art.

The feature of the embodiment of FIG. 7 consists of a padded part 54 sewn into the approximately triangular region between the glove thumb part 27 and the padded pocket 29" apposed at the glove index finger 26. The already large "catch hand" formed by the inward glove part 11 and the integrated padded pockets 28", 29", 30" is further considerably enlarged by the pad 54. The pad 54 may be formed in simple manner of two layers sandwiching the padding material. Preferably one layer is integral with the inward glove part 11 and the other layer is integral with the upward glove part 10. The padding material sewn into the pad 54 assures adequate dimensional stability of the catching area and furthermore it will not significantly affect the mobility of the glove fingers 26, 27 relative to each other.

I claim:

1. A sports glove comprising:

a) an impact-damping inward glove part made of a foamed latex material for covering the front surface of a human hand, said inward glove part having at least a portion extending laterally thereof;

b) an upward glove part for covering the back of a human hand, said upward glove part having at least a portion extending laterally thereof;

c) side parts for connecting said upward and inward glove parts about at least a portion of respective perimeter edges thereof;

d) intra glove-finger pieces connecting said upward and inward glove parts along at least two respective finger forming portions thereof to provide at least one glove finger, and;

e) at least one pocket formed by a pocket wall connecting said upward and inward glove parts and spaced from at least one of said side parts and interior of each of said laterally extending portions, said at least one pocket being filled with a padding material whereby said sports glove envinces a larger catching area relative to the anatomic requirements of the users hand.

2. A Sports glove as claimed in claim 1, wherein said at least one pocket having a width corresponding to the width of said at least one glove finger.

3. A Sports glove as claimed in claim 1, wherein said at least one pocket is disposed outside said at least one glove finger corresponding to at least one of the small human little finger and the human thumb and extends to the wrist.

4. A Sports glove as claimed in claim 1, and wherein said at least one pocket extends around the tip of said at least one glove finger and in a manner whereby said inward glove part extends beyond the respective ends of the human finger.

5. A Sports glove as claimed in claim 4, and wherein at least two of said at least one glove finger forming portions are connected to each other.

6. A Sports glove as claimed in claim 5, and wherein said connected at least two of said at least one finger forming portions are mutually connected in webbed manner by the interposition therebetween of a V-shaped connecting pocket.

7. A Sports glove as claimed in claim 6, and wherein said V-shaped connecting pocket is filled with a soft, highly compressible foam for providing dimensional stability.

8. A Sports glove as claimed in claim 1, and wherein at least two of said finger forming portions flare apart from each other in a V-shaped manner such that the two human fingers positionable therein are spread apart by a V-shaped gap.

9. A Sports glove as claimed in claim 8, and wherein soft foam is provided within said V-shaped gap and comprises a molded finger bed matching the lateral topology of a human finger.

10. A Sports glove as claimed in claim 1, and wherein said side parts and said pocket wall each have a height, said side part has a height greater than said pocket wall whereby said sports glove has an overall dish shape.

11. A Sports glove as claimed in claim 1, and further comprising means for stiffening said upward glove part, said stiffening means spanning at least the upper human finger phalanx of a users hand.

12. A Sports glove as claimed in claim 1, and further including:

a) a glove thumb for covering the thumb of a human hand;

b) a glove index finger for covering the index finger of a human hand;

c) an approximately triangular region extending between and connecting in a mutually displaceable manner said glove thumb and said glove index finger, said triangular region is filled with a pad member.

13. A Sports glove as claimed in claim 12, and wherein said pad member consists essentially of at least two layers sandwiching a padding material, one of said at least two layers being integral with said inward glove part and the other of said at least two layers being integral with said upward glove part.

14. A Sports glove comprising:

a) an inward glove part made of an impact damping material for covering the front surface of a human hand, said inward part having at least a portion extending laterally thereof;

b) a glove upward part for covering the back of the human hand , said upward part having at least a portion extending laterally thereof;

c) side parts for connecting said inward and upward parts about at least a portion of respective perimeter edges;

d) glove intra-finger pieces connecting said upward and inward parts alone at least two respective finger forming portions thereof to provide at least one glove finger, and;

e) at least one pocket formed between said inward part laterally extending portion and said upward part laterally extending portion and including a pocket side wall spaced from at least one of said side parts, said at least one pocket is filled with a padding material whereby said sports glove evinces a larger catching area relative to the anatomic requirements of the users hand.

* * * * *